US005727657A

United States Patent [19]

Foelix

[11] Patent Number: 5,727,657

[45] Date of Patent: Mar. 17, 1998

[54] APPARATUS FOR BLOCKING ELEVATOR CAR TRAVEL

[75] Inventor: Heinrich Foelix, Schaffhausen, Switzerland

[73] Assignee: Inventio AG, Hergiswil NW, Switzerland

[21] Appl. No.: 595,033

[22] Filed: Jan. 31, 1996

[30] Foreign Application Priority Data

Jan. 31, 1995 [CH] Switzerland ..... 00257/95

[51] Int. Cl.[6] ..... B66B 5/16

[52] U.S. Cl. ..... 187/356; 187/414

[58] Field of Search ..... 187/300, 313, 187/314, 350, 351, 356, 357, 404, 414

[56] References Cited

U.S. PATENT DOCUMENTS 2,726,735 12/1955 Rohnberg ..... 187/357
3,687,237 8/1972 Capra ..... 187/356

FOREIGN PATENT DOCUMENTS 7518439 6/1975 Germany .
3056378 3/1991 Japan .
3293278 12/1991 Japan .
6239551 8/1994 Japan .
667638 10/1988 Switzerland .
709497 1/1980 U.S.S.R. ..... 187/356

*Primary Examiner*—Kenneth Noland
*Attorney, Agent, or Firm*—William J. Clemens

[57] ABSTRACT

A travel blocking apparatus is mounted in an elevator shaft to block travel of an elevator car or a counterweight into a temporary working space such as, for example, an elevator shaft pit or head. One or more travel blocking devices selectively pivot into the travel path of the car or the counterweight to block further travel in the desired direction. During each travel of the car away from the protected area, the travel blocking devices are retracted and upon each stop of the car are tilted to the blocking position. These movements of the travel blocking devices are sensed by safety switches to continuously check the functional capability of the travel blocking apparatus. An unlatching and release device positioned above the shaft door must be actuated by a key to open the shaft door, whereby a memory circuit is actuated further interrupting safety circuits. The memory circuit must be reset by a key switch in the machine room in order for the elevator car to resume operation.

20 Claims, 5 Drawing Sheets

APPARATUS FOR BLOCKING ELEVATOR CAR TRAVEL

BACKGROUND OF THE INVENTION

The present invention relates generally to an apparatus for blocking travel of an elevator car and, in particular, to an apparatus for blocking travel of an elevator car to an area of an elevator shaft where a person is working.

Working spaces in elevator shafts are, for example, shaft pits and shaft heads. Temporary occupation of such working spaces by persons is due to requirements for periodic maintenance and checking of elevator equipment according to regulations. Relevant regulations, propose for the protection of the persons temporarily located in these working spaces that the spaces be dimensioned with consideration of the full travel path of the elevator car to the end positions of the shaft to guarantee adequate safety height for the personnel working therein. See, for example, the Official Journal of the European Communities No. L 213/8, "Essential Health and Safety Requirements Relating to the Design and Construction of Lifts and Safety Components". This is, however, not possible in all cases, in particular on the refurbishing of elevator plants in existing buildings.

A travel path limiter apparatus having at least one abutment which is adjustable over the entire travel path length is shown in the German patent specification 75 18 439.3. The travel path limiter is constructed as an abutment plate with a fastening hook which is hooked into elongate holes formed in the guide rails where the travel of the elevator car must be limited for the protection of persons working in the shaft.

The effectiveness of this known apparatus presupposes that the personnel is informed of its presence, that the abutment plates are available at any time and that the personnel actually use the plates under the pressure of time and for what is expected to be only a brief time in the working space. Therefore, a reliable protection of persons can not be guaranteed.

The Swiss patent specification 667 638 shows protective equipment which is pivotally mounted in the shaft pit, in the form of a travel blocking device which, upon the opening of the lowermost shaft door in the absence of an elevator car, an abutment stay automatically pivots into the travel path of the car. Thereby, the shaft pit space is secured against the ingress of the car and the demanded protection of persons is provided in principle. After the person leaves the shaft pit, the travel blocking device is brought manually into the initial position.

Equipment of this type include mechanical and electrical components which must maintain their full functional capability during the entire operating life of the elevator system. This functional capability must therefore be checked periodically in order to guarantee a permanently reliable functioning of the protective equipment. The manual resetting from the interior of the shaft involves a certain risk of a worker being locked in upon the closing of the shaft door by a second person from outside and furthermore means an appreciable loss of convenience in the application.

SUMMARY OF THE INVENTION

The present invention concerns an apparatus for blocking travel of an elevator car in an elevator shaft. The apparatus includes at least one travel blocking device, such as a swivel buffer or a swivel lever, adapted to be pivotally mounted in an elevator shaft adjacent a path of travel of an elevator car for pivoting between a non-active position permitting travel of the elevator car or a counterweight along the path of travel adjacent the travel blocking device and an active position for contacting the elevator car or the counterweight and blocking further travel of the elevator car along the path of travel in a predetermined direction. The apparatus also includes an actuator attached to the travel blocking for moving between an extended position and a retracted position, the actuator being responsive to activation for moving to the extended position and pivoting the travel blocking device to the non-active position, the travel blocking device automatically pivoting into the active position moving the actuator into the retracted position when the actuator is not activated. The apparatus further includes an unlatching and release device connected to the actuator for preventing activation of the actuator when an associated shaft door is open and the elevator car is not adjacent the open associated shaft door.

The swivel buffer can have an actuating finger attached thereto for actuating at least one safety switch mounted in the elevator shaft when the swivel buffer is in the active position. The swivel buffer also can have a switching flank formed thereon for actuating a position switch mounted in the elevator shaft when the elevator car contacts the swivel buffer.

The actuator has a plunger movable between the extended position and the retracted position and pivotally attached to the travel blocking device. The unlatching and release device includes a memory circuit being responsive to unlatching of the associated shaft door for preventing activation of the actuator. The memory circuit includes a latching switch connected in a safety circuit with the actuator, the latching switch being movable to a set position interrupting the safety circuit in response to the unlatching of the associated shaft door, and a resetting element coupled to the latching switch for selectively moving the latching switch from the set position to a reset position restoring the safety circuit.

In one embodiment, the unlatching and release device includes a lock actuating means coupled to a switching cam, the switching cam being coupled to the latching switch, whereby actuation of the lock actuating means rotates the switching cam to move the latching switch from the reset position to the set position. In another embodiment, the unlatching and release device includes a pawl, a first lock actuating means engaging the pawl, a second lock actuating means, a slide being movable between a first position covering the second lock actuating means and a second position uncovering the second lock actuating means, a switching slide cam coupled between the second lock actuating means and the latching switch and a lug attached to the switching slide cam and engaging the pawl for preventing movement of the switching slide cam whereby actuation of the first lock actuating means disengages the pawl from the lug, movement of the slide from the first position to the second position exposes the second lock actuating means and subsequent actuation of the second lock actuating means moves the switching slide cam to move the latching switch to the set position.

It is therefore an object of the present invention to create a protective device the function of which guarantees a certain protection for a worker and also signals faulty operation of the protective device.

The advantages achieved by this invention are that the functional reliability of the travel blocking apparatus is assured by a continues functional check or that a fault is noticed at once and that the apparatus fully automatically assumes both active and non-active positions.

Further advantages are that, with simultaneous fulfillment of the regulations for the personnel protection, appreciable building costs can be saved in that the reduced depth and height of a travel shaft frees additional space volumes for other purposes.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
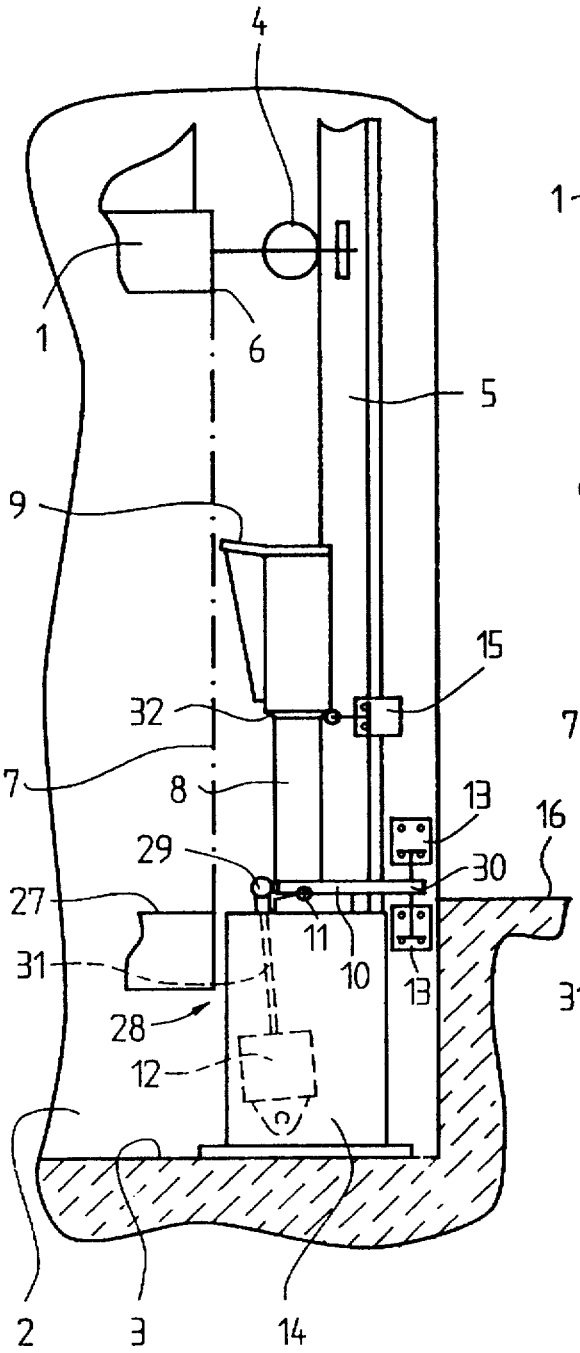
FIG. 1 is a schematic fragmentary elevation view of an elevator including an elevator car travel blocking apparatus according to the present invention in a non-active position.

As shown in the FIG. 1, an elevator car 1 is positioned in an elevator shaft 2 for travel in upward and downward directions and has a plurality of roller guides 4 mounted thereon which engage vertically extending guide rails 5 mounted in the shaft. When the car 1 travels to a lowermost floor 16 it assumes a lowermost car position 27 in the shaft 2. An automatic travel blocking apparatus 28 is installed in a shaft pit 3 at the bottom of the shaft 2 for blocking travel of the car 1 to the area of the position 27 under certain conditions. A low-friction pivot bearing 11, on which a generally vertically extending swivel buffer 8 is pivotally mounted, is in turn mounted on a buffer pedestal 14 which rests on a bottom surface of the pit 3. The low-friction pivot bearing 11 can be constructed as a knife bearing such as is commonly utilized in mechanical weighing devices.

An upper end of the swivel buffer 8 is formed in the shape of a buffer plate 9, which plate juts out laterally and serves as a bearing surface for an impact edge 6 of a bottom surface of the car 1. A foot of the swivel buffer 8 is constructed as a buffer level 10 which has a joint 29 at a left end thereof and an horizontally extending right end which is shaped as an actuating finger 30 for actuating a pair of redundant safety switches 13 mounted in the shaft 2 adjacent the floor 16. An actuator 12, which is pivotally mounted on the buffer pedestal 14, is pivotally attached by a plunger 31 to the joint 29 of the buffer level 10. An upper portion of the swivel buffer 8 is of increased diameter at about half the full height to form a generally downwardly facing switching flank 32 for actuating a position switch 15 mounted on the guide rail 5.

In the FIG. 1, the swivel buffer 8 is illustrated in a non-active position pushed into a generally vertical alignment by the actuator 12 such that the buffer plate 9 is situated outside a generally vertically extending path of travel 7 of the impact edge 6 of the elevator car 1. In this non-active position of the swivel buffer 8, the car 1 can travel without obstruction to the lowermost floor 16 along the path of travel 7 adjacent the swivel buffer. In order to maintain the swivel buffer 8 in the non-active position, the actuator 12 must be activated to extend the plunger 31 in order to exert a continuous generally upwardly directed thrust force on the joint 29 thereby pivoting the swivel buffer about the pivot bearing 11.

Figure 2:
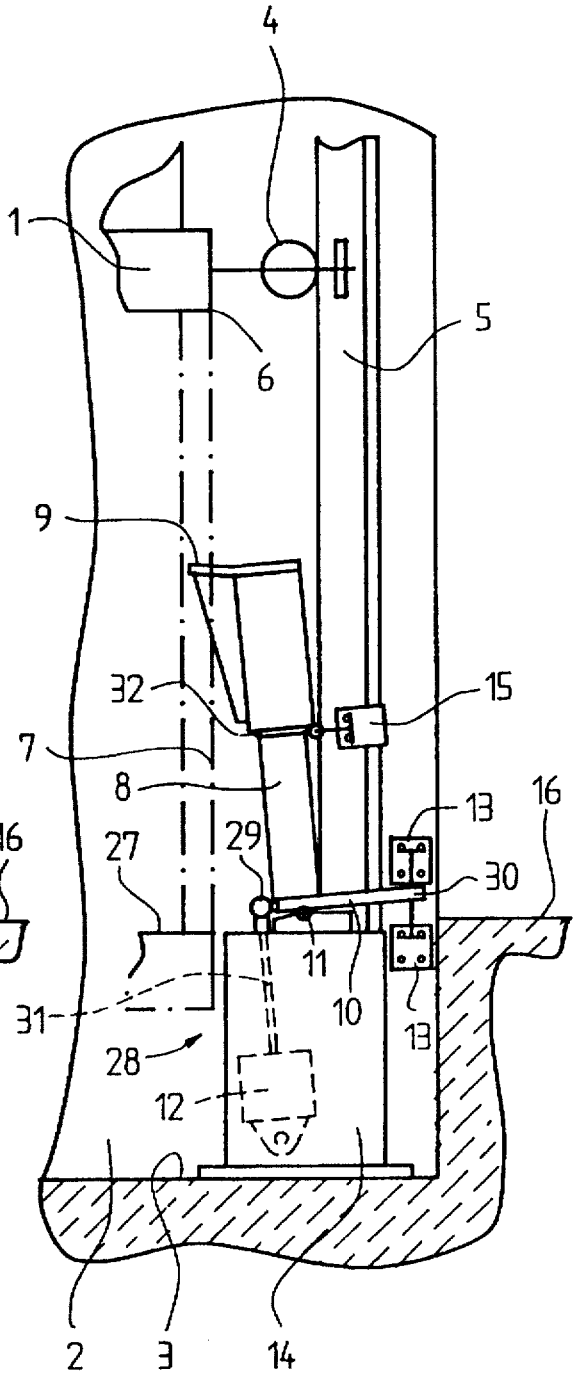
FIG. 2 is a view similar to the FIG. 1 in which the travel blocking apparatus is in an active position.

In the FIG. 2, the actuator 12 is not activated and the swivel buffer 8 is tilted into a travel blocking, active position by its own weight due to an asymmetrical mass distribution to the left over the pivot bearing 11 to position the buffer plate 9 in the path of travel 7. When the swivel buffer 8 tilts, the plunger 31 is retracted and the safety switches 13 are switched by the actuating finger 30 to generate an appropriate signal to an associated safety circuit and elevator control (see FIG. 11). The actuator 12 can be any suitable type of linear actuator which extends the plunger 31 when activated by, for example, electrical power and, when the power is removed, provides little or no resistance to retraction of the plunger due to movement of swivel buffer 8 to the active position.

Figure 3:
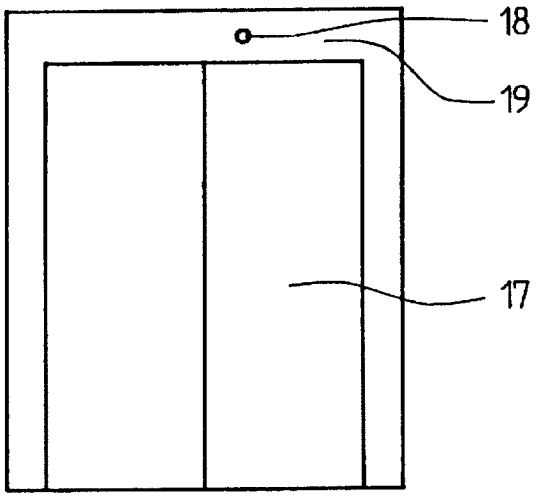
FIG. 3 is a front elevation view of an elevator shaft door showing a portion of the unlatching and release device of the travel blocking apparatus of the FIG. 1 accessible from the hall.
Figure 5:
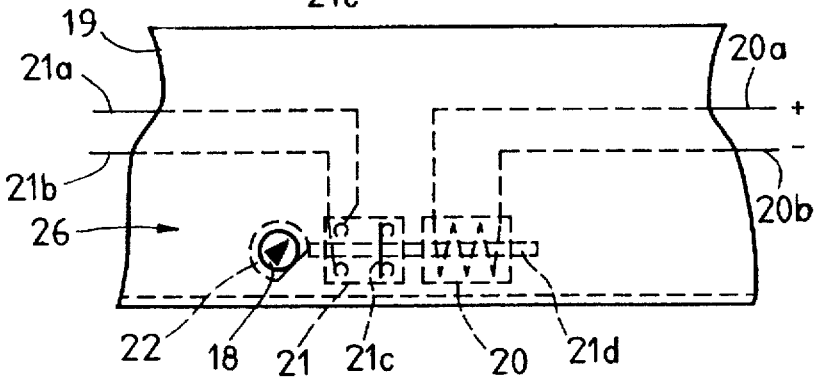
FIG. 5 is view similar to the FIG. 4 showing the unlatching and release device upon actuation.
Figure 6:
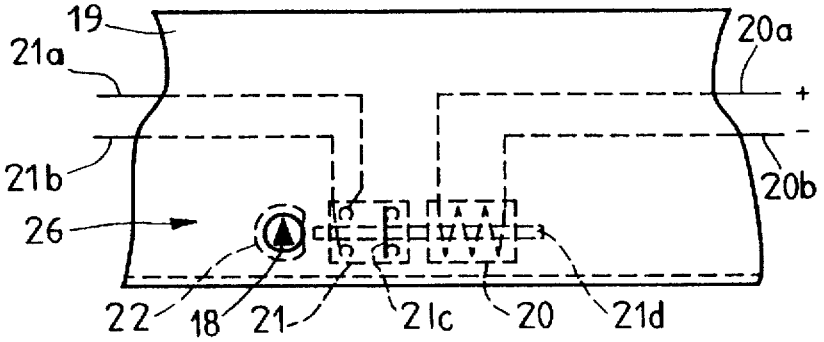
FIG. 6 is view similar to the FIG. 5 showing the unlatching and release device after the actuation and before resetting.

In the FIG. 3 there is shown an elevator shaft door 17 viewed from the front or hall side and having a lock actuating means in the form of a triangular bolt 18, for example, mounted in an upper portion of a frame 19 surrounding the door. The bolt 18 is normally covered by a screw lid (not shown) or a slide (not shown). The bolt 18 is provided for unlatching of the shaft door 17 by rotation of the bolt utilizing a standard triangular key. In the unlatching and release device according to the present invention, not only a mechanical unlatching of the shaft door 17 is accomplished with the triangular bolt 18, but a memory circuit is also set and a safety circuit interrupted, as illustrated in the FIGS. 4, 5 and 6.

Figure 4:
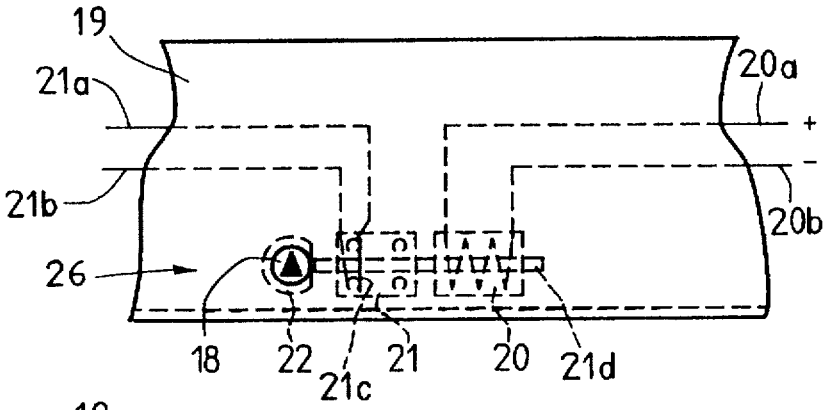
FIG. 4 is an enlarged fragmentary view of the unlatching and release device shown in the FIG. 3 before actuation.

An unlatching and release device 26 including the bolt 18 and a memory circuit having a latching switch 21 and a resetting element 20 forcing the latching switch to an initial setting is shown in the FIG. 4. The switch 21 has a first pair of contacts connected to a pair of signal lines 21*a* and 21*b* representing a safety circuit (see the FIG. 11) and bridged by a switch element 21*c*. The actuation of the memory circuit takes place by way of a switching cam 22 coupled to the triangular bolt 18. When the triangular bolt 18 is rotated through a predetermined angle, a switch actuator rod 21*d* of the latching switch 21 is moved by the rotated cam 22 into a detent setting or set position as shown in the FIG. 5 and remains in this setting after the release of the triangular bolt 18. The actuator rod 21*d* is coupled to the switch element 21*c* which is moved away from the first set of switch contacts, thereby interrupting the safety circuit, to bridge a second set of switch contacts. Upon release, the bolt 18 is rotated by a spring force to the initial position as shown in the FIG. 6. However, the switch element 21*c* and the actuator rod 21*d* remain in the detent or set position. In order to reset the latching switch 21, activation of the resetting element 20 is required. The resetting element 20 can be, for example, an electromagnet connected to a switched electrical power source (not shown) by a pair of power supply lines 20*a* and 20*b*. Upon application of electrical power to the lines 20*a* and 20*b* by the elevator control (see FIG. 11), the switch element 21*c* and the actuator rod 21*d* are shifted to the left and back to the initial position shown in the FIG. 4.

Figure 7:
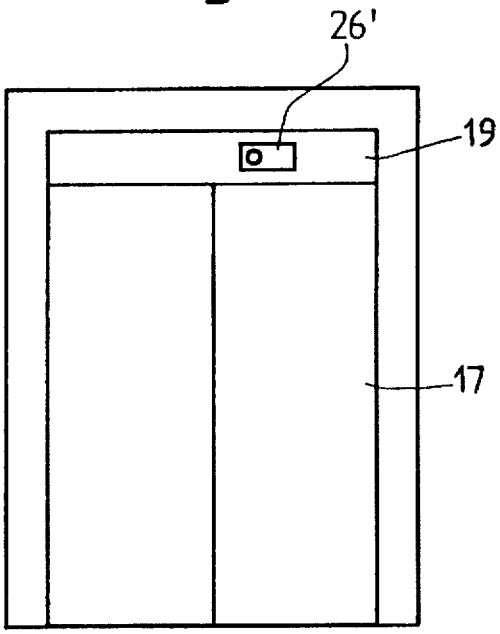
FIG. 7 is view similar to the FIG. 3 showing an alternate embodiment unlatching and release device according to the present invention.
Figure 8:
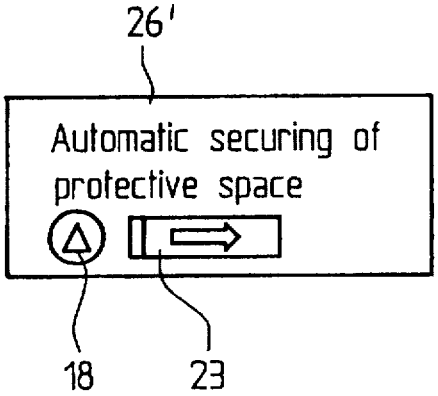
FIG. 8 is an enlarged view of the unlatching and release device shown in the FIG. 7.
Figure 9:
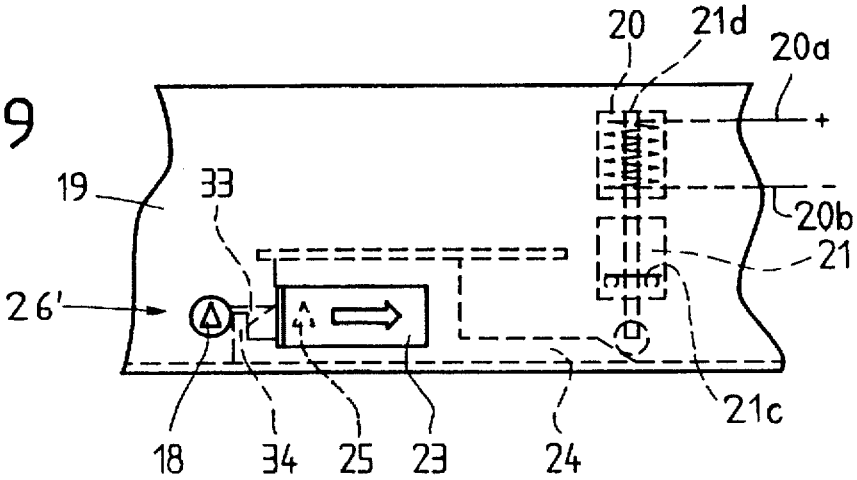
FIG. 9 is an enlarged fragmentary view of the unlatching and release device shown in the FIG. 7 before actuation.
Figure 10:
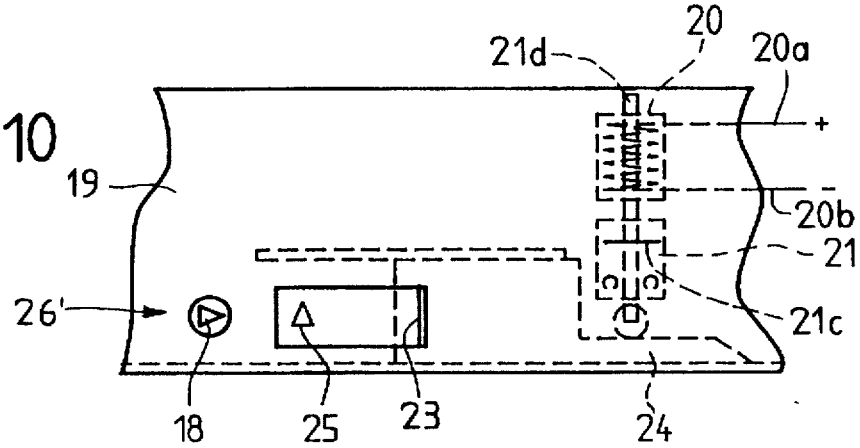
FIG. 10 is a view similar to the FIG. 9 showing the unlatching and release device during actuation.

There is shown in the FIGS. 7 and 8, an alternate embodiment two-stage unlatching and release device 26'. The mechanism and the function of this two-stage unlatching and release device is shown in the FIGS. 9 and 10 wherein the resetting element 20 and the latching switch 21 have been spaced from the triangular bolt 18 and positioned in a generally vertical orientation. An initial setting of the device 26' is shown in the FIG. 9. Upon rotation of the triangular bolt 18, a pawl 33 is lifted over a lug 34 attached to a switching slide cam 24. When the pawl 33 is in the raised position, a slide 23 can be pushed manually to the right from a first position shown in the FIG. 9 to a second position shown in the FIG. 10. In the first position, the slide 23 covers a second lock actuating element in the form of a triangular bolt 25. In the second position of the slide 23, the bolt 25 is uncovered and can be rotated to move the cam 24 to the right to actuate the latching switch 21 into the detent or set position. The final unlatching of the shaft door 17 takes place only by the rotation of the second triangular bolt 25. The resetting of the latching switch 21 takes place in the same manner as described above. After movement to the second position, the slide 23 preferably is retracted to the first position by a spring (not illustrated). The latching switch 21 remains in the detent or set position and must be reset by the resetting element 20 as described above.

Figure 11:
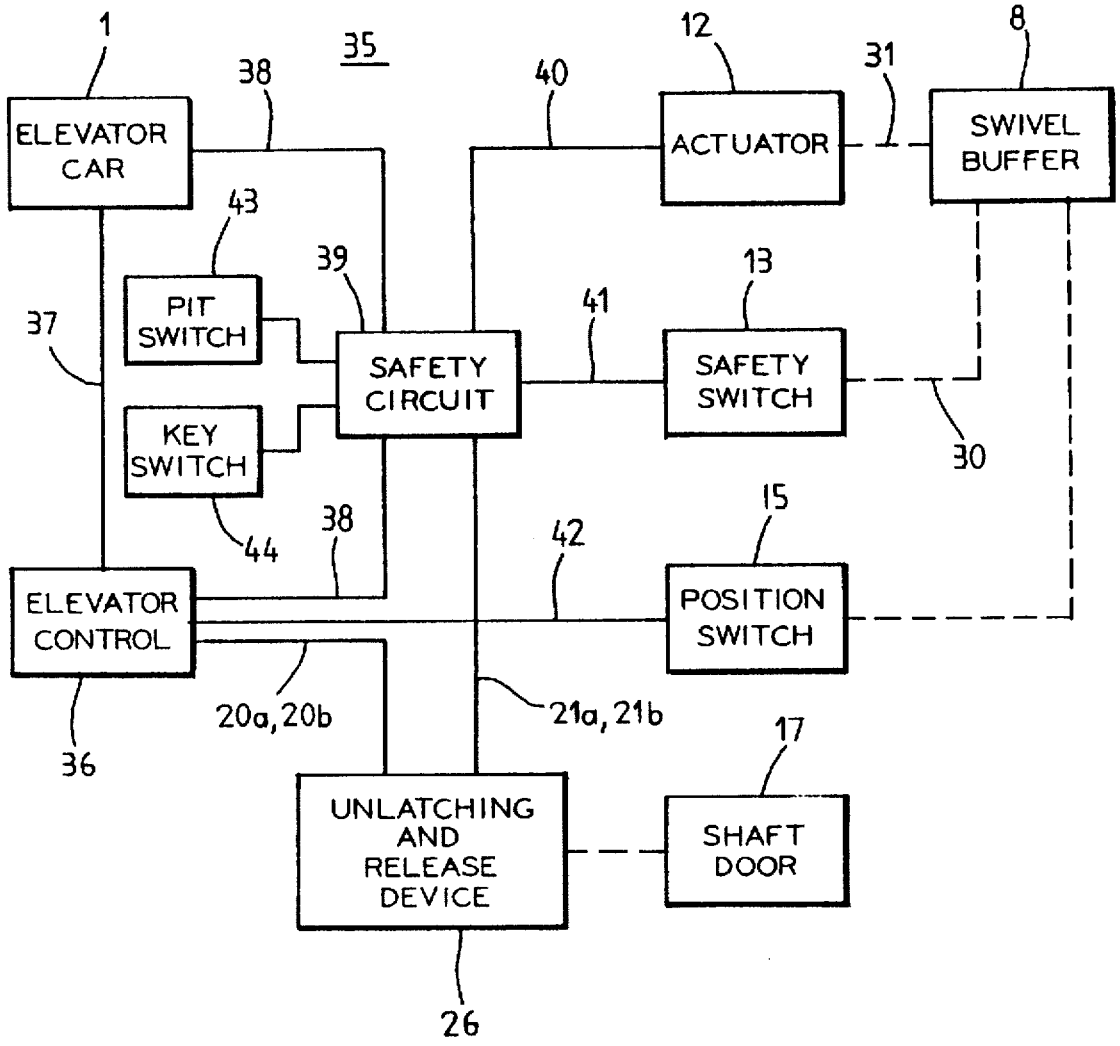
FIG. 11 is a block diagram of an elevator control system including the travel blocking apparatus according to the present invention.

There is shown in the FIG. 11 a block diagram of an elevator system 35 incorporating the travel blocking apparatus according to the present invention. The elevator car 1 is connected to an elevator control 36 by a communication line 37 for exchanging information related to car travel, calls and other elevator operations. Certain operations of the elevator system 35 also require the elevator car 1 and the elevator control 36 to be connected by safety circuit lines 38 to a safety circuit 39 which prevents undesired and faulty operation of the elevator system 35. The unlatching and release device 26, or the alternate embodiment device 26', is connected to the elevator control 36 by the power supply lines 20*a* and 20*b* for actuating the resetting element 20 to reset the latching switch 21. The unlatching and release device 26, or the alternate embodiment device 26', also is connected to the safety circuit 38 by the signal lines 21*a* and 21*b* for disabling the actuator 12 which is connected by an actuator line 40 to the safety circuit. The actuator 12 is mechanically coupled to the swivel buffer 8 by the plunger 31. The swivel buffer 8 is mechanically coupled to the safety switches 13 by the actuating finger 30 and the safety switches are connected to the safety circuit 39 by a switch line 41. The position switch 15 is mechanically actuated by the swivel buffer 8 as shown in the FIGS. 1 and 2 and the shaft door 17 is mechanically coupled to the unlatching and release device 26 in a conventional manner. The position switch 15 is connected to the elevator control 36 by a position line 42. Also connected to the elevator control 36 through the safety circuit 39 is a pit switch 43 and a key switch 44 which switches are explained below.

The operation of the elevator car travel blocking apparatus according to the present invention is as follows:

In order for a worker to be able to climb into the shaft pit 3, the car 1 is sent to a higher floor. The shaft door 17 at the lowermost floor 16 can be unlatched and opened utilizing either the unlatching and release device 26 which requires rotating the bolt 18 with a standard triangular key, or the two-stage unlatching and release device 26' which requires rotating the bolts 18 and 25 with the key. The rotation of the triangular bolt 18 or the triangular bolt 25 moves the latching switch 21 into the detent or set position whereby the safety circuit 39 is interrupted. The safety circuit 39 thereby prevents the actuator 12 from extending in response to the disconnecting of the signal lines 21*a* and 21*b* from one another by the switch 21. The shaft door 17 can now be opened manually and be maintained in the open setting. After the car 1 has moved away from the lowermost floor 16, the swivel buffer 8, or preferably an opposed pair of the swivel buffers, tilts automatically into the path of travel 7 and thus blocks the return of the car to the lowermost floor. After the worker climbs into the shaft pit 3, he can actuate the control off pit switch 43 (see FIG. 11), required by regulation in the pit, so that a multiple interruption of the safety circuit 39 is achieved. The maintenance and checking work to be undertaken can now be performed with reduced risk.

After completion of the work in the shaft pit 3, the pit switch 43 is released and the shaft door 17 is closed and latched. However, the elevator car 1 still is not yet ready for operation because the latching switch 21 of the memory circuit is in the set position interrupting the safety circuit 39. Now, the resetting element 20 is activated by the key switch 44 (see FIG. 11) of the elevator control 36 located outside the elevator shaft preferably in the machine room. The key switch 44 applies power to the power supply lines 20*a* and 20*b* to reset the latching switch 21. The elevator car 1 is again fully ready for operation and the actuator 12 is once again enabled to extend the plunger 31 and move the swivel buffer 8 to the non-activated position.

Continuous checking of the functional reliability of the travel blocking apparatus according to the present invention is achieved through cycling the swivel buffers 8, with the exception of a travel to the lowermost floor 17, by switching off the actuator 12 after each travel of the car 1 and by switching on the actuator before each travel of the car. The operation of the swivel buffers 8 during a travel of the car 1 can be checked by monitoring the safety switches 13 for their respective settings. This functional test can take place during each travel of the car 1 or, according to the local conditions, at programmed time intervals, for example daily or weekly or after a predetermined number of travels under the direction of the elevator control 36. Thereby, on one hand, a faulty function is detected at once and on the other hand, a faulty function, such as a sticking of the travel blocking apparatus in the vertical position due to non-use for a long period of time, is prevented.

If, for any reason, the car 1 lowers even with the doubly switched-off safety circuit 39, then the impact edge 6 will come into contact with the buffer plate 9, press the swivel buffer 8 in somewhat and the car will be stopped. The pressing-in of the swivel buffer 8, however, causes an actuation of the position switch 15 by the switching flank 32 which generates a signal to the elevator control 36 on the position line 42. The signal representing the actuation of the position switch 15 can be stored and/or evaluated by the elevator control 36.

For the monitoring and the operation of the travel blocking apparatus, the following variations of operational sequences can be performed:

For elevators with small numbers of travels, the actuator 12 is isolated from the power supply by the elevator control 36 after each travel of the elevator, whereby the swivel buffer 8, with the exception for a car position at the lowermost floor 16, tilts each time into the travel blocking position and the safety switches 13 are actuated. The signal generated by the actuation of the switches 13 is linked logically with other safety signals in the elevator control 36 and, in the case of correct function of the travel blocking device, enables the further travel of the elevator car 1. An absent of the signal from the safety switches 13 signifies a defect in the operation of the travel blocking device which can block travel of the elevator 1 to the lowermost floor 16 and results in calling a maintenance service to the scene.

In buildings with much passenger traffic, correspondingly great numbers of travels are also made by the elevator car 1. According to the above described functional pattern, this also results in a correspondingly large number of changes in setting of the travel blocking device, which can mean premature wear of the components. For this case, the release of the swivel buffer 8 is executed, for example, once daily or once weekly for checking purposes by appropriate control programs in the elevator control 36. Should the shaft pit 3 be entered while the swivel buffer 8 is in the non-active position, the actuator 12 is isolated from the power supply by the latching switch 21 in response to the rotation of the triangular bolt 18, or bolts 18 and 25, and the swivel buffer then tilts into the travel blocking position.

In the case of longer checking intervals, energy also is provided for a correspondingly long time to the actuator 12 for the holding-back of the swivel buffer 8, which has the consequence of greater heating or the need for greater size of the actuator, as well as a greater energy consumption. In order to avoid this and nevertheless to gain from the advantage of a greater checking interval, the swivel buffer 8 is retracted only before the entry of the car 1 into the lowermost stopping floor 16 and again released after the stopping of the car under the direction of the elevator control 36. The swivel buffer 8 now lies against the outside of the car side wall and then tilts automatically back into the travel blocking position upon the car 1 travelling away from the floor 16. A simple sliding surface provided on the car side wall prevents a hooking or catching of the swivel buffer 8 onto the car structure. With this mode of operation, there results a short switching-on duration of the actuator 12 and a smaller overall size as well as also a smaller number of changes in setting of the travel blocking device and thus less wear.

Basically similar equipment can also be used for and elevator shaft of limited shaft head height. In this case, two constructions are possible: positioning of the swivel buffers 8 below the counterweight similar to the system shown in the FIG. 1; and arrangement of the swivel buffers below the shaft ceiling. The swivel buffers 8, or their buffer pedestals 14, are fastened at the shaft ceiling and the mass distribution of the swivel buffer is so disposed that a pivoting into the travel path 7 of the car 1 takes place only by means of their own weight. All remaining functions and operations are exactly the same as described above. For the application for the protection of the protective space above the car, all shaft doors, with the exception of the lowermost one, are equipped with an unlatching and release device of the type shown in the FIGS. 7 through 10.

Figure 12:
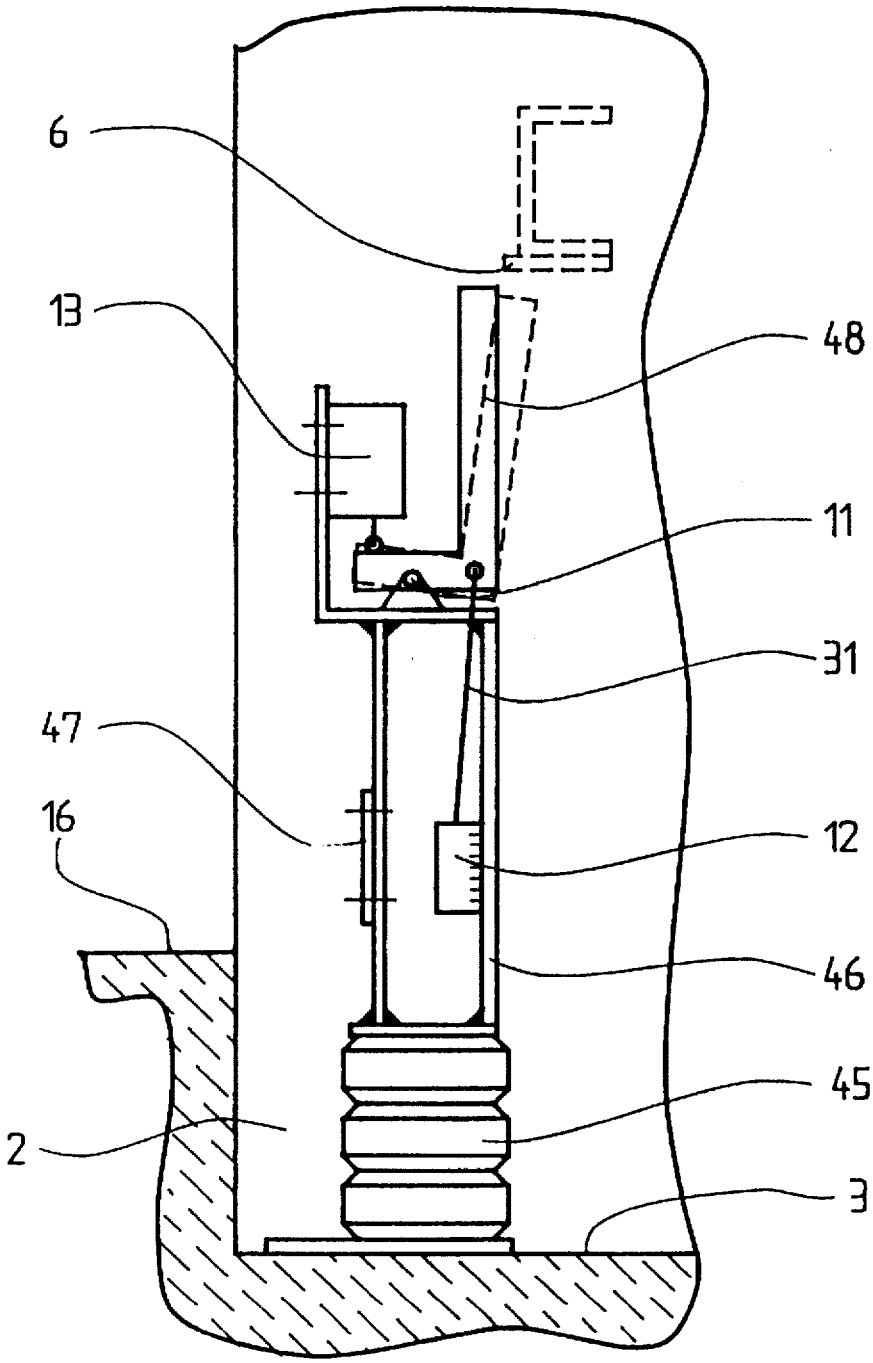
FIG. 12 is view similar to the FIGS. 1 and 2 showing an alternate embodiment travel blocking apparatus according to the present invention.

In the FIGS. 1 and 2, the swivel buffer 8, the buffer plate 9 and the buffer level 10 form a travel blocking device. In the FIG. 12 there is shown another embodiment of a travel blocking device according to the present invention. The swivel buffer 8, the buffer plate 9 and the buffer level 10 are replaced by a generally L-shaped rigid swivel lever 48. A conventional elevator shaft buffer 45 and a frame 46 are mounted in the shaft pit 3 of the elevator shaft 2 in place of the buffer pedestal 14. The buffer 45 can be an energy storing type or an energy dissipating type, dependent on the weight and speed of the car. As shown, the buffer 45 is an energy saving type with damping. Mounted on an upper end of the buffer 45 is the generally vertically extending frame 46 which, for example, is made from a plurality of steel plates welded together. Attached to an upper end of the frame 46 is the pivot bearing 11. The swivel lever 48 includes a generally horizontally extending leg pivotally mounted on the pivot bearing 11 approximately at a midpoint of the leg.

The actuator 12 is attached to an inner wall of the frame 46 and the plunger 31 has its free end pivotally attached to the lever 48 at a junction of a right end of the horizontally extending leg and a lower end of a generally vertically extending leg of the lever. The safety switch 13 is mounted on a vertical extension of the frame 46. A left end of the horizontally extending leg of the lever 48 actuates the safety switch 13 in a manner similar to the actuating finger 30 of the swivel buffer 8 shown in the FIGS. 1 and 2. The frame 46 is connected to a guide rail mounted in the elevator shaft, such as the guide rail 5 shown in the FIGS. 1 and 2, by a fastening armature 47 in such a way that movement in a horizontal plane is prevented, but movement in a vertically direction is permitted. Vertical movement is desired for braking if the impact edge 6 of a car strikes the swivel lever 48 when the lever is in the active position as shown in dashed line in the FIG. 12.

The apparatus according to the present invention can be used in principle for any type of conveying equipment which at the end positions has maintenance spaces, which spaces are limited in the depth or height, with resultant danger to maintenance persons. The travel blocking device of either embodiment can be utilized to block the travel of an elevator car or a counterweight.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for blocking travel of an elevator car in an elevator shaft comprising:

at least one travel blocking device adapted to be pivotally mounted in an elevator shaft adjacent a path of travel of an elevator car for pivoting between a non-active position permitting travel of the elevator car along the path of travel and an active position for contacting one of the elevator car and a counterweight connected to the elevator car and blocking further travel of the elevator car along the path of travel in a predetermined direction;

an actuator attached to said travel blocking device for moving between an extended position and a retracted position, said actuator being responsive to activation for moving to said extended position and pivoting said travel blocking device to said non-active position, said travel blocking device automatically pivoting into said active position moving said actuator into said retracted position when said actuator is not activated; and an unlatching and release device connected to said actuator for preventing activation of said actuator in response to an associated shaft door being open and the elevator car not being adjacent the open associated shaft door.

2. The apparatus according to claim 1 wherein said travel blocking device is a swivel buffer and said swivel buffer has an actuating finger attached thereto for actuating at least one safety switch mounted in the elevator shaft when said swivel buffer is in said active position.

3. The apparatus according to claim 1 wherein said travel blocking device is a swivel buffer and said swivel buffer has a switching flank formed thereon for actuating a position switch mounted in the elevator shaft when the elevator car contacts said swivel buffer.

4. The apparatus according to claim 1 wherein said actuator has a plunger movable between said extended position and said retracted position and pivotally attached to said travel blocking device.

5. The apparatus according to claim 1 wherein said unlatching and release device includes a memory circuit being responsive to unlatching of the associated shaft door for preventing activation of said actuator.

6. The apparatus according to claim 5 wherein said memory circuit includes a latching switch connected in a safety circuit with said actuator, said latching switch being movable to a set position interrupting said safety circuit in response to the unlatching of the associated shaft door, and a resetting element coupled to said latching switch for selectively moving said latching switch from said set position to a reset position restoring said safety circuit.

7. The apparatus according to claim 6 wherein said unlatching and release device includes a lock actuating means coupled to a switching cam, said switching cam being coupled to said latching switch, whereby actuation of said lock actuating means rotates said switching cam to move said latching switch from said reset position to said set position.

8. The apparatus according to claim 6 wherein said unlatching and release device includes a pawl, a first lock actuating means engaging said pawl, a second lock actuating means, a slide being movable between a first position covering said second lock actuating means and a second position uncovering said second lock actuating means, a switching slide cam coupled between said second lock actuating means and said latching switch and a lug attached to said switching slide cam and engaging said pawl for preventing movement of said switching slide cam whereby actuation of said first lock actuating means disengages said pawl from said lug, movement of said slide from said first position to said second position exposes said second lock actuating means and subsequent actuation of said second lock actuating means moves said switching slide cam to move said latching switch to said set position.

9. The apparatus according to claim 1 wherein said travel blocking device is a swivel lever and said swivel lever has a leg for actuating at least one safety switch mounted in the elevator shaft when said swivel buffer is in said active position.

10. The apparatus according to claim 9 including an elevator shaft buffer, a frame mounted on an upper end of said elevator shaft buffer and said swivel lever being pivotally mounted on said frame.

11. An elevator system comprising:

an elevator car movable along a path of travel in an elevator shaft and having an impact edge formed thereon;

at least one travel blocking device pivotally mounted in said elevator shaft adjacent said path of travel for pivoting between a non-active position permitting travel of said elevator car along said path of travel adjacent said travel blocking device and an active position for contacting said impact edge and blocking further travel of said elevator car along said path of travel in a predetermined direction;

an actuator pivotally mounted in said elevator shaft and having a plunger attached to said travel blocking device, said actuator being selectively activated for moving said plunger to an extended position in which said travel blocking device is pivoted to said non-active position, said travel blocking device automatically pivoting into said active position moving said plunger into said retracted position when said actuator is not activated; and an unlatching and release device connected to said actuator for selectively preventing said plunger from moving to said extended position in response to an associated shaft door being open and the elevator car not being adjacent the open associated shaft door.

12. The apparatus according to claim 11 wherein said unlatching and release device includes a latching switch connected in a safety circuit with said actuator, said latching switch being movable to a set position interrupting said safety circuit in response to the unlatching of the associated shaft door, and a resetting element coupled to said latching switch for selectively moving said latching switch from said set position to a reset position restoring said safety circuit.

13. The apparatus according to claim 12 wherein said unlatching and release device includes a rotatably mounted switching cam coupled to said latching switch for moving said latching switch from said reset position to said set position in response to a predetermined rotation of said switching cam and a lock actuating means coupled to said switching cam for rotating said switching cam.

14. The apparatus according to claim 12 wherein said unlatching and release device includes a pawl, a first lock actuating means engaging said pawl, a second lock actuating means, a slide being movable between a first position covering said second lock actuating means and a second position uncovering said second lock actuating means, a switching slide cam coupled between said second lock actuating means and said latching switch and a lug attached to said switching slide cam and engaging said pawl for preventing movement of said switching slide cam whereby actuation of said first lock actuating means disengages said pawl from said lug, movement of said slide from said first position to said second position exposes said second lock actuating means and subsequent actuation of said second lock actuating means moves said switching slide cam to move said latching switch to said set position.

15. An elevator system comprising:

an elevator car movable along a path of travel in an elevator shaft;

an elevator control connected to said elevator car for controlling movement of said elevator car along said path of travel;

at least one travel blocking device pivotally mounted in said elevator shaft adjacent said path of travel for pivoting between a non-active position permitting travel of said elevator car along said path of travel and an active position for contacting one of said elevator car and a counterweight connected to said elevator blocking further travel of said elevator car along said path of travel in a predetermined direction;

an actuator pivotally mounted in said elevator shaft and having a plunger attached to said travel blocking device, said actuator being connected to said elevator control and being responsive to activation by said elevator control for selectively moving said plunger to an extended position in which said travel blocking device is pivoted to said non-active position, said travel blocking device automatically pivoting into said active position moving said plunger into said retracted position when said actuator is not activated; and an unlatching and release device connected to said actuator and responsive to unlatching of an associated shaft door for setting a memory circuit said memory circuit selectively preventing said plunger from moving to said extended position when the associated shaft door is open and the elevator car is not adjacent the open shaft door.

16. The apparatus according to claim 15 including at least one safety switch mounted in said elevator shaft and being connected to said elevator control, said safety switch being actuated by said travel blocking device in said active position for generating a signal to said elevator control and wherein said elevator control performs a periodical functional test of said travel blocking device and said actuator by activating said actuator and monitoring said safety switch for said signal, said elevator control stopping travel of said elevator car upon detection of an absence of said safety switch signal.

17. The apparatus according to claim 16 wherein said elevator control terminates activation of said actuator after each travel of said elevator car, said elevator control responding to said safety switch signal to enable further travel of said elevator car and responding to an absence of said safety switch signal by generating a call for maintenance service.

18. The apparatus according to claim 16 wherein said elevator control terminates activation of said actuator at predetermined time intervals, said elevator control responding to said safety switch signal to enable further travel of said elevator car and responding to an absence of said safety switch signal by generating a call for maintenance service.

19. The apparatus according to claim 16 wherein said elevator control activates said actuator before arrival of said elevator car at the associated shaft door and terminates activation of said actuator when said elevator car has stopped adjacent the associated shaft door.

20. The apparatus according to claim 15 including a key switch positioned outside said elevator shaft and connected to said elevator control for resetting said memory circuit.

* * * * *